US012635780B1

(12) United States Patent
Nguyen

(10) Patent No.: US 12,635,780 B1
(45) **Date of Patent: *May 26, 2026**

(54) INTEGRAL NAIL POLISH STIRRING CAP

(71) Applicant: Quang Nguyen, Mt. Pleasant, SC (US)

(72) Inventor: Quang Nguyen, Mt. Pleasant, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/088,080

(22) Filed: Mar. 24, 2025

Related U.S. Application Data

(63) Continuation of application No. 18/786,411, filed on Jul. 26, 2024, now Pat. No. 12,256,824.

(51) Int. Cl.
*A45D 34/04* (2006.01)

(52) U.S. Cl.
CPC ..... *A45D 34/048* (2013.01)

(58) Field of Classification Search
CPC .. A45D 34/043; A45D 34/048; A45D 40/264; B65D 51/32
See application file for complete search history.

(56) References Cited

U.S. PATENT DOCUMENTS 2,631,826 A * 3/1953 Wolf ..... B43L 25/00 74/89.45
3,115,664 A 12/1963 Del Ponte
3,744,767 A 7/1973 Blasnik
5,857,772 A * 1/1999 Washington ..... B01F 33/5011 366/605
6,024,507 A * 2/2000 Joulia ..... B01F 27/118 401/129
6,508,603 B1 1/2003 Vasas
7,624,741 B2 * 12/2009 Jonckheere ..... A45D 34/048 132/218
11,457,718 B2 * 10/2022 Garrison ..... A45D 34/046

* cited by examiner

*Primary Examiner* — David P Angwin
*Assistant Examiner* — Bradley S Oliver
(74) *Attorney, Agent, or Firm* — Invention To Patent Services; Alex Hobson

(57) ABSTRACT

An integral nail polish stirring system includes an integral nail polish stirring cap that with a cap button that when pressed causes a stirring shaft to rotate within the nail polish to stir the nail polish. The cap button has a helical drive shaft extending down into a cap cavity and through a drive platform aperture in a rotating drive platform that rotates the rotating drive platform when the cap button is pressed. The stirring shaft extends from the rotating drive platform opposite the cap button. A spring in the actuation chamber between the cap button and the rotating drive platform returns the cap button to a ready position. The stirring shaft may have a mixing paddle, or an applicator configured thereon. The integral nail polish stirring cap may be interchanged between nail polish containers.

16 Claims, 7 Drawing Sheets

INTEGRAL NAIL POLISH STIRRING CAP

CROSS REFERENCE TO RELATED APPLICATIONS

This application is a continuation application of and claims the benefit of priority to U.S. patent application Ser. No. 18/786,411, filed on Jul. 26, 2024, and currently pending; the entirety of which is hereby incorporated by reference herein.

FIELD OF THE INVENTION

The invention relates to a nail polish cap having a mixing device configured therein.

BACKGROUND OF THE INVENTION

Background

Nail polish typically includes, solvents, pigments, plasticizers and the like. Before nail polish is applied it is mixed, such as by shaking the bottle by hand or with a mechanical shaker. This shaking gets the nail polish up inside the cap and along the applicator shaft. Nail polish on the applicator shaft can drip and make it difficult to apply uniformly over a nail.

SUMMARY OF THE INVENTION

The invention is directed to an integral nail polish stirring system and method of stirring nail polish. An integral nail polish stirring system utilizes an integral nail polish stirring cap that has an actuator, a cap button, that can be pressed to cause a stirring shaft to rotate within the nail polish. The stirring shaft may have a stirring tip, a more blunt extension from the stirring shaft to more effectively stir the nail polish. The stirring shaft may also be the applicator shaft with an applicator tip, such as a brush. The cap button has a helical drive shaft extending down into a cap cavity. and through a drive platform aperture in a rotating drive platform, coupled to the integral nail polish stirring cap. The rotating drive platform is configured to rotate or spin as the helical drive shaft moves through the drive platform aperture. The helical drive shaft may have a rectangular cross-sectional shape and the rotating drive platform aperture may have a corresponding rectangular shape that forces the rotating drive platform to rotate when the helical shaft moves therethrough. A spring configured in an actuation chamber between the rotating drive platform and the cap button forces the cap button to an original or ready position after the cap button is depressed and released. The rotating drive platform may be retained in a fixed position along the drive axis of the cap button by a platform retainer along the inner surface of the cap cavity, such as a flange, flanges, a ridge or recess in the cap. The rotating drive platform is therefore required to spin when the helical drive shaft is forced through the drive platform aperture by the cap button.

The integral nail polish stirring cap has cap threads for engagement with the threads of a nail polish container. The cap threads may be configured along a cap cavity inner surface and may be female threads configured to engage with the male threads on the exterior of the nail polish container. The integral nail polish stirring cap may be interchangeable from one nail polish container to another. A person may clean off the stirring shaft and stirring tip before attaching the integral nail polish stirring cap to a second nail polish container.

A conventional nail polish container has an interior volume or holds about 15 ml (0.5 fl. oz) of nail polish but may be larger and have an interior volume of about 20 ml or more, about 25 ml or more, about 30 ml or more and any range between and including the volumes provided.

An exemplary integral nail polish stirring cap has a cap cavity 32 which may include an actuation chamber between the cap button and the rotating drive platform. A spring may be configured between the rotating drive and the cap button to force the cap button away from the rotating drive platform along a drive axis. The cap button may be manually pushed and move into the actuation chamber of the cap cavity, thereby compressing the spring, and upon release of the force on the cap button, the spring forces the cap button back away and out of the actuation chamber. Again, as the cap button is depressed, the helical drive shaft moves through the drive platform aperture and rotates the rotating drive platform, which rotates the stirring shaft to stir and mix the components of the nail polish. When the spring forces the helical drive shaft to move back through the drive platform aperture, the drive platform aperture is rotated in a reverse direction from the direction when the cap button is depressed. One cyclical actuation of the helical drive shaft may force an effective amount of rotation of the rotating drive platform to stir and mix the nail polish, such as about one revolution or more, about two revolutions or more, about three revolutions of more, about four revolutions of more, about five revolutions or more and any range between and including the revolutions provided. On cyclical actuation is movement of the helical drive shaft in a first direction through the drive platform aperture. Depressing the cap button down into the actuation chamber of the cap cavity is one cyclical actuation of the helical drive shaft.

A spring may be a conventional coiled spring, a coil of wire that produces a spring constant, or it may be an elastomeric material that is deformable or compressible under a compressive load and then rebounds back to an original shape upon removal of the compressive load. An elastomeric material may be silicone, urethane, rubber or a foam, such as a closed cell foam, preferably, or an open cell foam. A slip plate may be configured between a spring and the rotating drive platform to reduce friction between the spring and the rotating drive platform. A slip plate may be a thin planar sheet of material, such as plastic, including polyethylene, and especially low friction plastic having a static coefficient of friction that is low, such as no more than about 0.25, such as no more than 0.2, no more than 0.1, or any range between and including the coefficient of friction values provide, when tested against itself according to ASTM 1894-14.

A stirring shaft extends from the container side of the rotating drive platform and down into the nail polish container. The stirring shaft is configured an offset distance from the center point of the rotating drive axis, where the drive platform aperture is configured through the rotating drive platform. This offset distance forms the radius of rotation of the stirring shaft within the nail polish container. This offset distance may be about 2 mm or more, about 4 mm or more, about 5 mm or more, about 7 mm or more and any range between and including the values provided. A nail polish container is generally small so a small radius of rotation may be effective to stir the nail.

A stirring shaft may have a stirring tip to more effectively stir the nail polish within the nail polish container. A stirring tip may extend radially out from the stirring shaft to from a blunt paddle. A stirring tip may be a brush and the stirring shaft may form an applicator shaft, wherein the integral nail polish stirring cap can be detached from the nail polish container, after depressing the cap button one or more times to stir and mix the nail polish, to apply nail polish to a nail. The stirring enabled by the integral nail polish stirring cap may minimize or prevent nail polish from being jostled and coating the cap and the applicator shaft.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
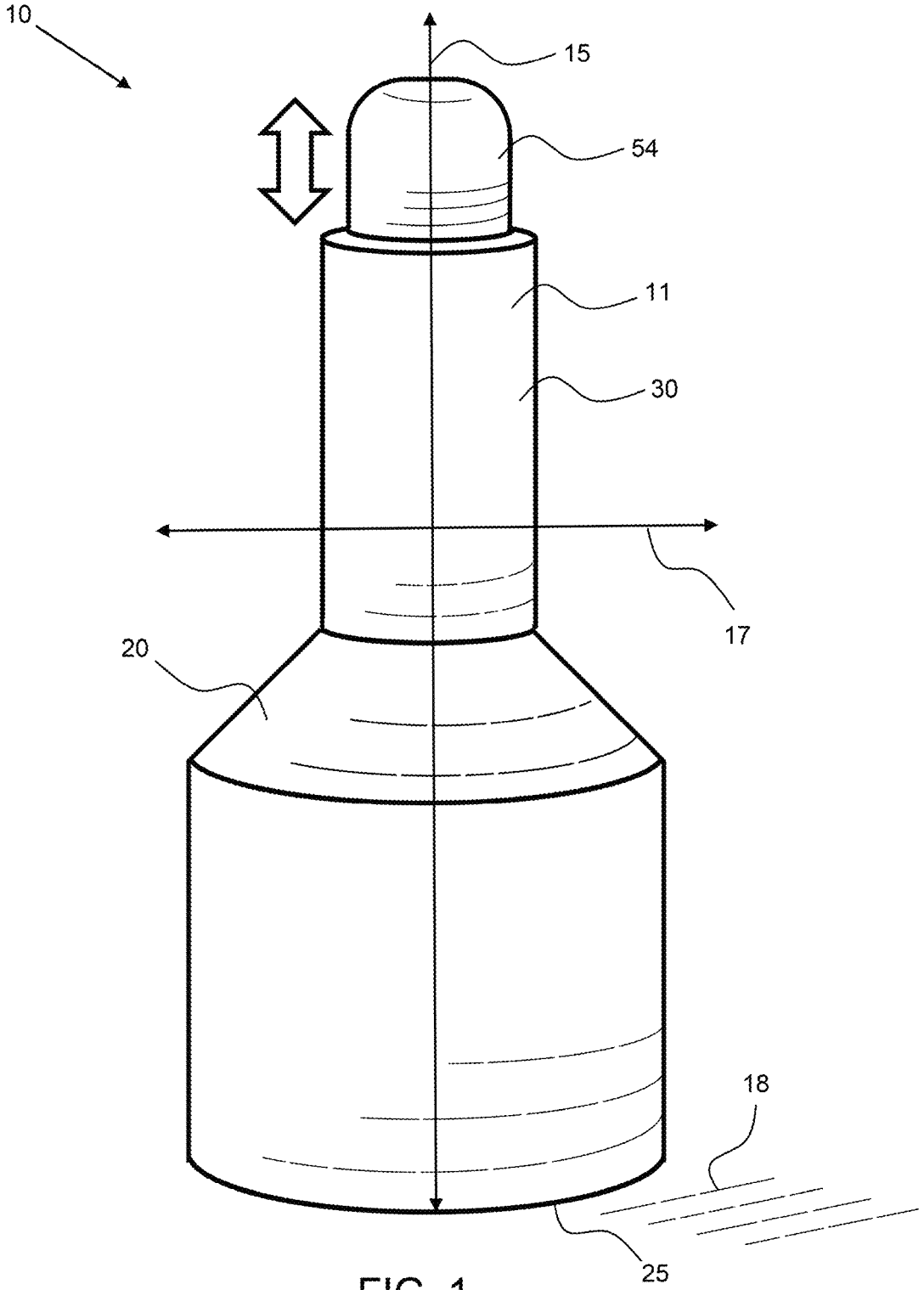
FIG. 1 shows a front view of an exemplary integral nail polish stirring system having a stirring apparatus configured in the cap of the nail polish container.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for the purpose of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

As shown in FIG. 1, an integral nail polish stirring system 10 includes an integral nail polish stirring cap 11 configured over a nail polish container 20. The cap 30 is removably attached to the nail polish container 20 at a container open end of the container. The cap button 54 is extends from a top of the cap 30 opposite the container open end, with respect to a vertical axis 15 with the nail polish container 20 resting on the base 25 of the container on a ground surface 18. A nail polish container is typically tapered from the main container body to a container open end 26 (shown in FIG. 3) and the cap 30 is configured vertically over the nail polish container 20 along a vertical axis 15. The cap is configured to move or actuate along the vertical axis 15. A horizontal axis 17 is orthogonal to the vertical axis 15.

Figure 2:
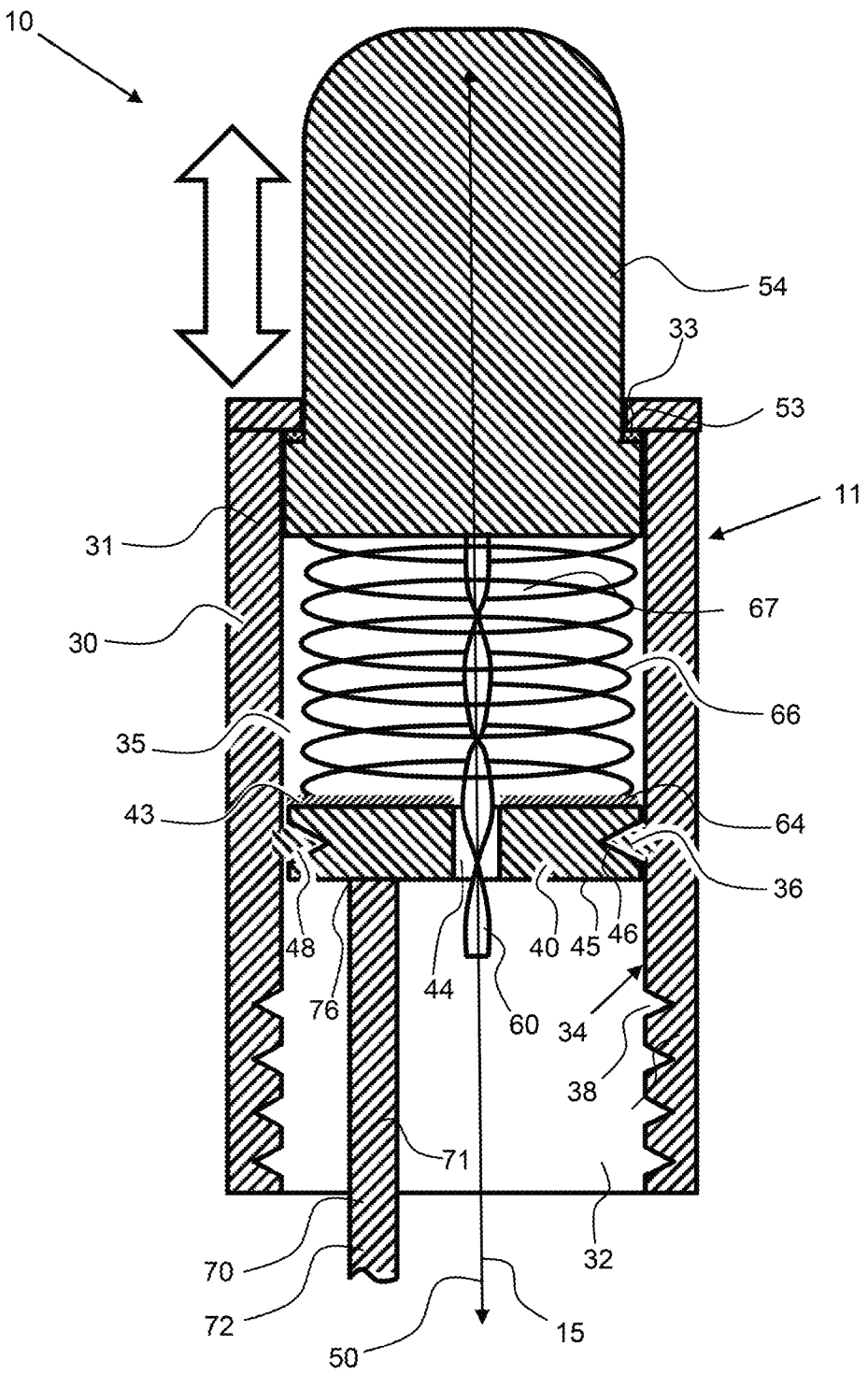
FIG. 2 shows a front cross-sectional view of a cap of the integral nail polish stirring system of FIG. 1.

As shown in FIG. 2, the cap 30 has a cap cavity 32 with a cap cavity inner surface 34. The cap button 54 extends from into the cap cavity 32 and may have a portion that extends out from the cap cavity. Cap threads 38 are also configured to detachably attach the cap to the nail polish container and may be female threads on the cap cavity inner surface 34. The outer surface of the cap 30 shown in FIG. 2 is cylindrical but may be other shapes, such as square or rectangular. The cap button 54 is configured to be manually actuated (by pressing with a finger) into the actuation chamber 35 of the cap cavity 32 and a helical drive shaft 60 extending from the cap button 54 is forced through a drive platform aperture 44 to rotate the rotating drive platform 40. A stirring shaft 71, extending from the container side 45 of the rotating drive platform 40 rotates about the drive axis 50 with the rotating drive platform 40 to stir the nail polish within the nail polish container. A spring 66 extends within the actuation chamber 35 between the button side 43 of the rotating drive platform 40 and the cap button 54. The spring 66 is depicted as a coiled spring but may be a resilient elastomeric material, such as a foam as described herein.

The rotating drive platform 40 is configured within the cap cavity 32 and forms the actuation chamber 35 between the rotating drive platform and the cap button 54. The rotating drive platform 40 may be disc shaped having a circular outer perimeter forming a platform engagement feature 46 with the cap 30, or more specifically the cap cavity inner surface 34. The platform engagement feature may be a groove 48 that mates with the platform retainer 36 of the cap 30, such as a cap flange or race along which the rotating drive platform is retained and moves with respect to the cap. Note that the platform retainer of the cap may be a recess or groove and the platform retainer may extend into this groove to retain the rotating drive platform vertically in position within the cap cavity 32. The groove 48 in the rotating drive platform and platform retainer 36, the cap flange, are mated whereby the rotating drive platform 40 may rotate about a drive axis 50.

The helical drive shaft 60 extends from the cap button 54, along the drive axis 50 through the actuation chamber 35 of the cap cavity 32 and through the drive platform aperture 44 in the rotating drive platform 40. The spring 66, configured within the cap cavity 32 between the rotating drive platform 40 and the cap button 54 or the actuation chamber 35 of the cap 30, may be configured around the drive axis 50 and the helical drive shaft 60. The spring may have a spring-shaft aperture 67 centrally located within the spring to allow the helical drive shaft to move freely within the cap cavity 32. The spring 66 may be connected to the cap button or simply be positioned within the actuation chamber 35 and retained therein. A slip plate 64 may be configured between the spring 66 and the rotating drive platform 40 to reduce any friction between the spring and the rotating drive platform. A slip plate may be a thin planar sheet of material, such as plastic that slides or rotates between the spring and the rotating drive platform. The spring may be a helical coil spring or an elastomeric material that forces the cap button away from the rotating drive platform and the spring may cause the cap button 54 to actuate back to a ready position as shown in FIG. 2. In a ready position, the spring may compress a gasket 53 configured between the cap button 54 and the cap body 31, such as against a cap flange 33, to produce a seal to prevent nail polish from drying out and prevent solvents from escaping from the integral nail polish stirring cap 11.

Figure 3:
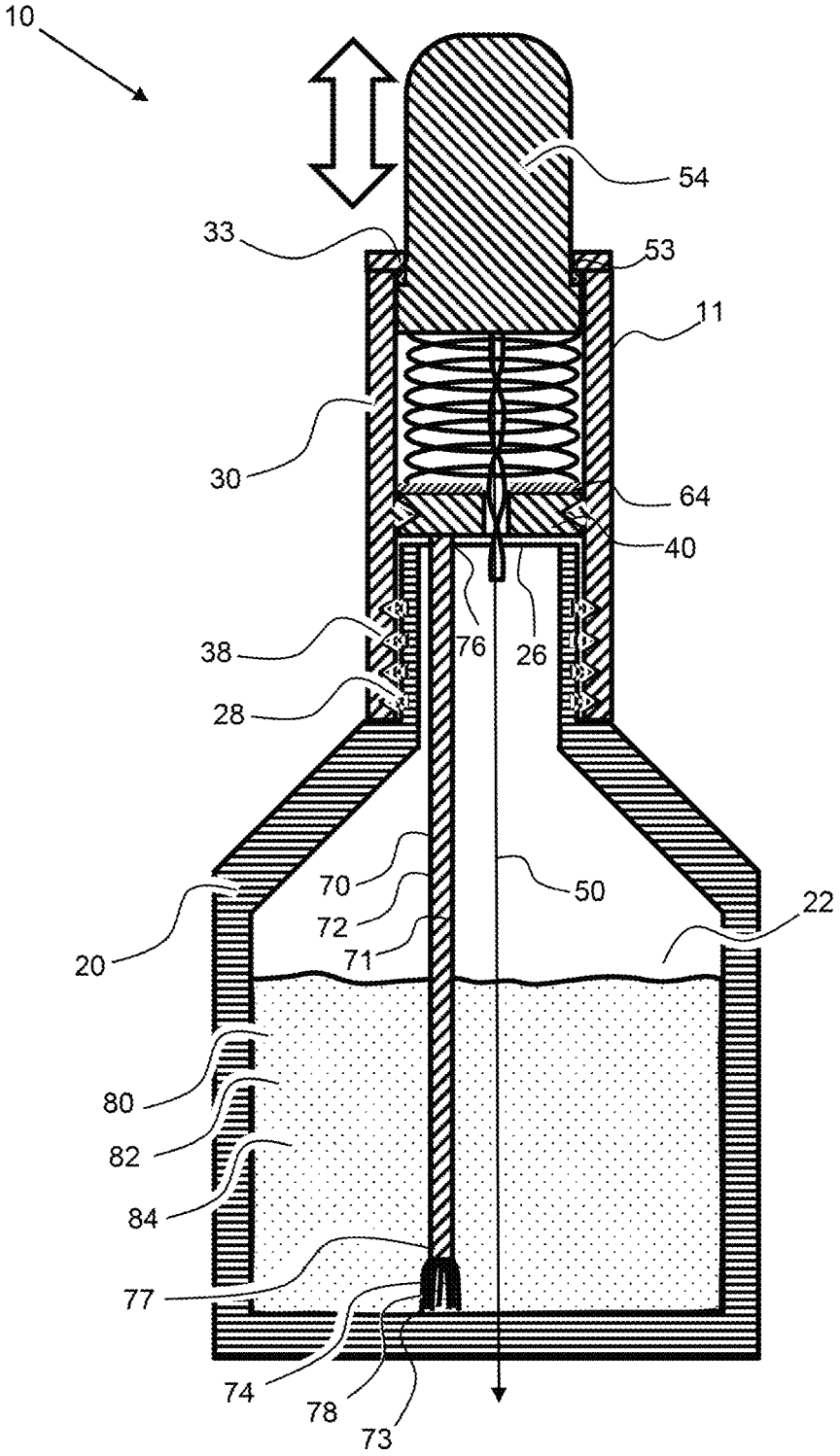
FIG. 3 shows a front cross-sectional view of the integral nail polish stirring system of FIG. 1.

Referring now to FIG. 3, a stirring shaft 71, which may be an applicator shaft 72 of an applicator 70, extends from a connected end 76, connected to the rotating drive platform 40, through the cap cavity 32 and into the nail polish container (not shown in FIG. 2). The stirring shaft 71 may extend parallel to the drive axis 50. The rotating drive platform 40 is configured between and separates the stirring shaft 71 from the cap button 54 and the spring 66.

A nail polish solution 80 is configured within a reservoir 22 of the nail polish container 20 and has a first component 82 and second component 84 that should be mixed before application of the nail polish to a nail. The stirring shaft 71 extends from the rotating drive platform 40 into the reservoir 22 and into the nail polish solution 80. A stirring tip 73, which may be an applicator tip 74 or brush 78 is configured on the extend end 77 of the stirring shaft 71, opposite the connected end 76 that is coupled to the rotating drive platform 40.

As shown in FIG. 3, the cap 30 is removably attached to the nail polish container 20 at the container open end 26. The cap threads 38 engage with corresponding container threads 28, configured proximal to the container open end, to secure the cap 30 to the nail polish container 20.

Figure 4:
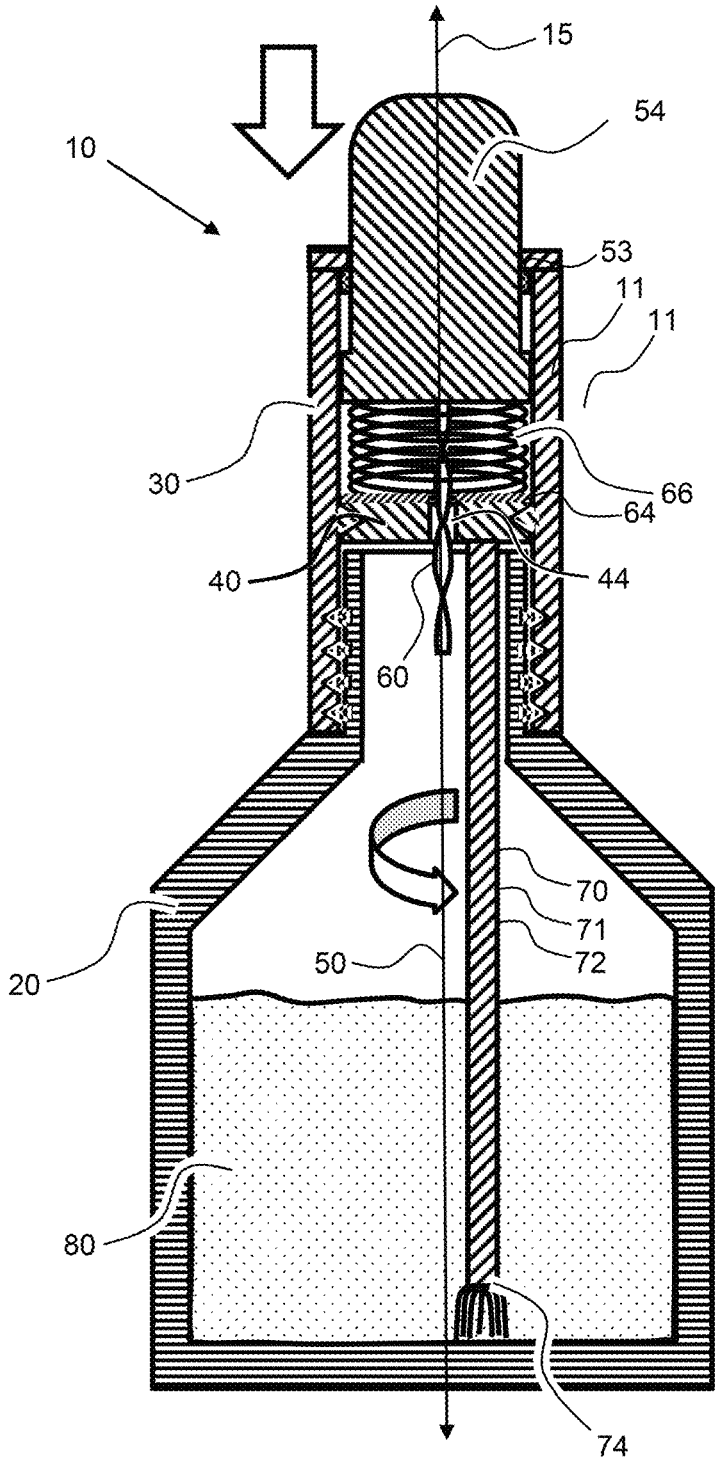
FIG. 4 shows a front cross-sectional view of the integral nail polish stirring system of FIG. 1 after a cap has been depressed.
Figure 5:
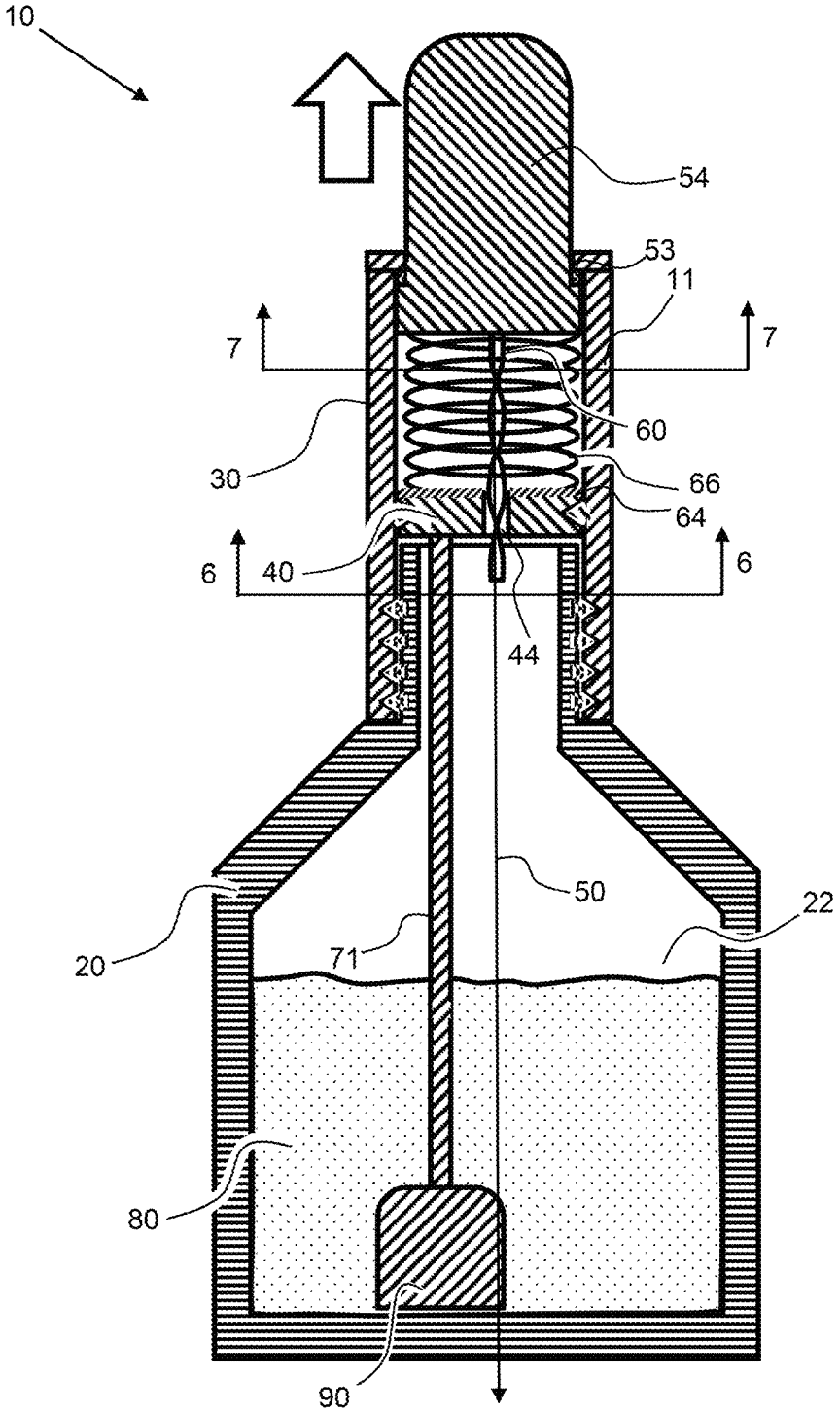
FIG. 5 shows a front cross-sectional view of the integral nail polish stirring system of FIG. 1 with an applicator replaced by a mixing paddle.
Figure 6:
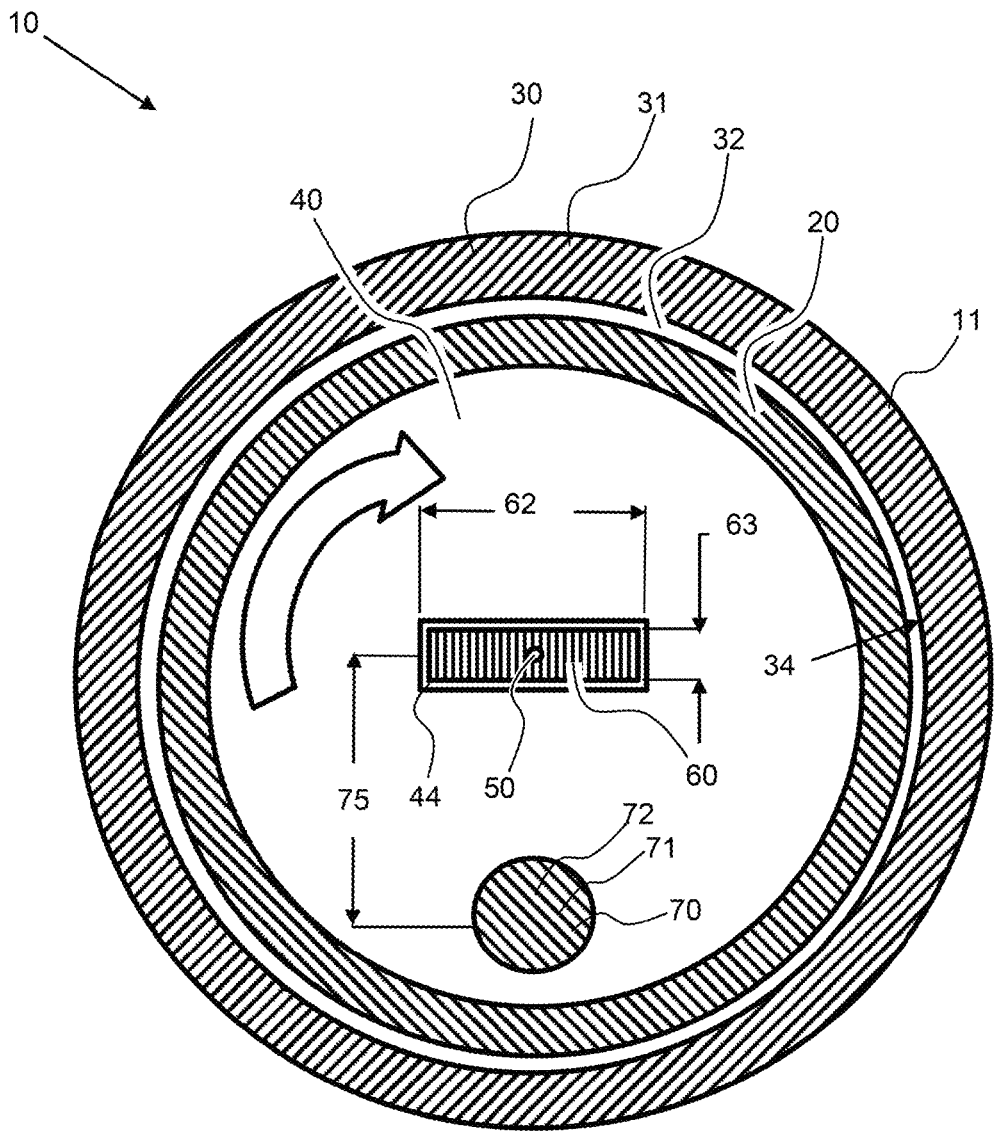
FIG. 6 shows a cross-sectional view of the integral nail polish stirring cap along line 6-6 of FIG. 5.

Referring not to FIGS. 4 to 6, as the cap button 54 is configured to be manually actuated or pressed down into the cap cavity to cause the rotating drive platform to rotate. In FIG. 4, the cap button is actuated or depressed towards the nail polish container 20 along the drive axis 50 and the helical drive shaft 60 is forced through the drive platform aperture 44 to spin or rotate the rotating drive platform 40. As shown in FIG. 4, spring 66 is compressed which produces a force to return the cap button back to a ready position, retained by this spring force and cap body 31.

The helical drive shaft 60 may have a length that is slightly longer than the length of the actuation chamber 35 and may be configured not to extend into the nail polish solution 80 within the nail polish container 20. The shape of the helical drive shaft 66 is a helix that is configured in a direction about the drive axis 50. Put a different way, the helical drive shaft may be a twisted strip of material that has a width 62 and a thickness 63, as shown in FIG. 6. The helical drive shaft may be rectangular in shape having a ratio of length to width that is about 1.25:1 or more, about 1.5:1 or more, about 2.0:1 or more, about 2.5:1 or more and any range between and including the ratios provided. The drive platform aperture 44 may be rectangular in shape also. Therefore, when the helical drive shaft 60 is forced through the drive platform aperture 44, the rotating drive platform 40 must rotate so that the drive platform aperture 44 accommodates the shape of the helical drive shaft 60. The helical drive shaft produces a force along the drive platform aperture to rotate the rotating drive platform. A rectangular shape of the helical drive shaft is therefore preferred as it provides increased torque on the rotating drive platform 40. Therefore, depressing the cap button 54 causes the rotating drive platform 40 to rotate via the actuation of the helical drive shaft 60 through the drive platform aperture 44. Since the rotating drive platform 40 is retained by the platform retainer 36, the rotating drive platform 40 rotates in a single plane about the drive axis 50 when the cap button 54 is depressed.

The stirring shaft 71, or applicator 70 extends from the rotating drive platform, and moves in a circular motion about the drive axis 50 when the rotating drive platform 40 rotates about the drive axis 50. The stirring tip 73 is configured within the nail polish solution 80 within the nail polish container 20 and stirs the nail polish solution 80 as the rotating drive platform rotates about the drive axis 50. The stirring shaft 71, or applicator shaft 72 is fixed at an offset distance 75 (shown in FIG. 6) from the drive axis 50 that extends through the drive platform aperture 44. Therefore, the stirring shaft 71, or applicator 70 rotates in a circular motion about the drive axis 50. This allows the nail polish solution 80 to be mixed uniformly.

As shown in FIG. 5, the cap button 54 is forced up after being depressed by the spring. The spring 66 is compressed when the cap button 54 is depressed towards the nail polish container 20 and forces the cap button back upwards away from the container or base of the container after the depressing force is removed. The spring 66 extends or rebounds upon removal of a depressing force to force the cap button 54 away from the nail polish container 20 and into its original position, or ready position. This causes the helical drive shaft 60 to retract back through the drive platform aperture 44. Due to the shapes of the helical drive shaft 60 and the drive platform aperture 44, the rotating drive platform 40 rotates about the drive axis 50 when the helical drive shaft 60 is retracted back through the drive platform aperture 44. This causes the stirring shaft 71 to move in a reverse circular motion about the drive axis 50, from the direction of rotation caused when the cap button is depressed. This allows the stirring shaft 71 and stirring tip to mix the nail polish solution 80 both when the button is depressed and when it automatically rebounds to a ready position, by the spring force.

As shown in FIG. 5, a mixing paddle 90 is configured on the extends from the rotating drive platform into the nail polish solution 80. As described herein, the integral nail polish stirring cap 11 may be placed on a nail polish container to mix the mail polish and then be removed for the original nail polish cap to be placed thereon having an applicator attached. The integral nail polish stirring cap 11 including the mixing paddle 90 and stirring shaft 71 may be cleaned before insertion of the original nail polish cap. A mixing paddle may be detachably attachable to the rotating drive platform 40, wherein the mixing paddle 90 and applicator 70, shown in FIG. 4, can be interchanged. A person may mix the nail polish solution 80 with the mixing paddle attached and then remove the mixing paddle and attach the applicator for application of nail polish solution to their nails.

As shown in FIG. 6, the stirring shaft 71, or applicator shaft 72 of an applicator 70 is connected to the rotating drive platform 40 at an offset distance 75 from the drive platform aperture 44. The helical drive shaft 60 is configured within the drive platform aperture 44. The helical drive shaft causes the rotating drive platform to rotate, as indicated by the bold curved arrow, due to the helix shape of the helical drive shaft 60.

Figure 7:
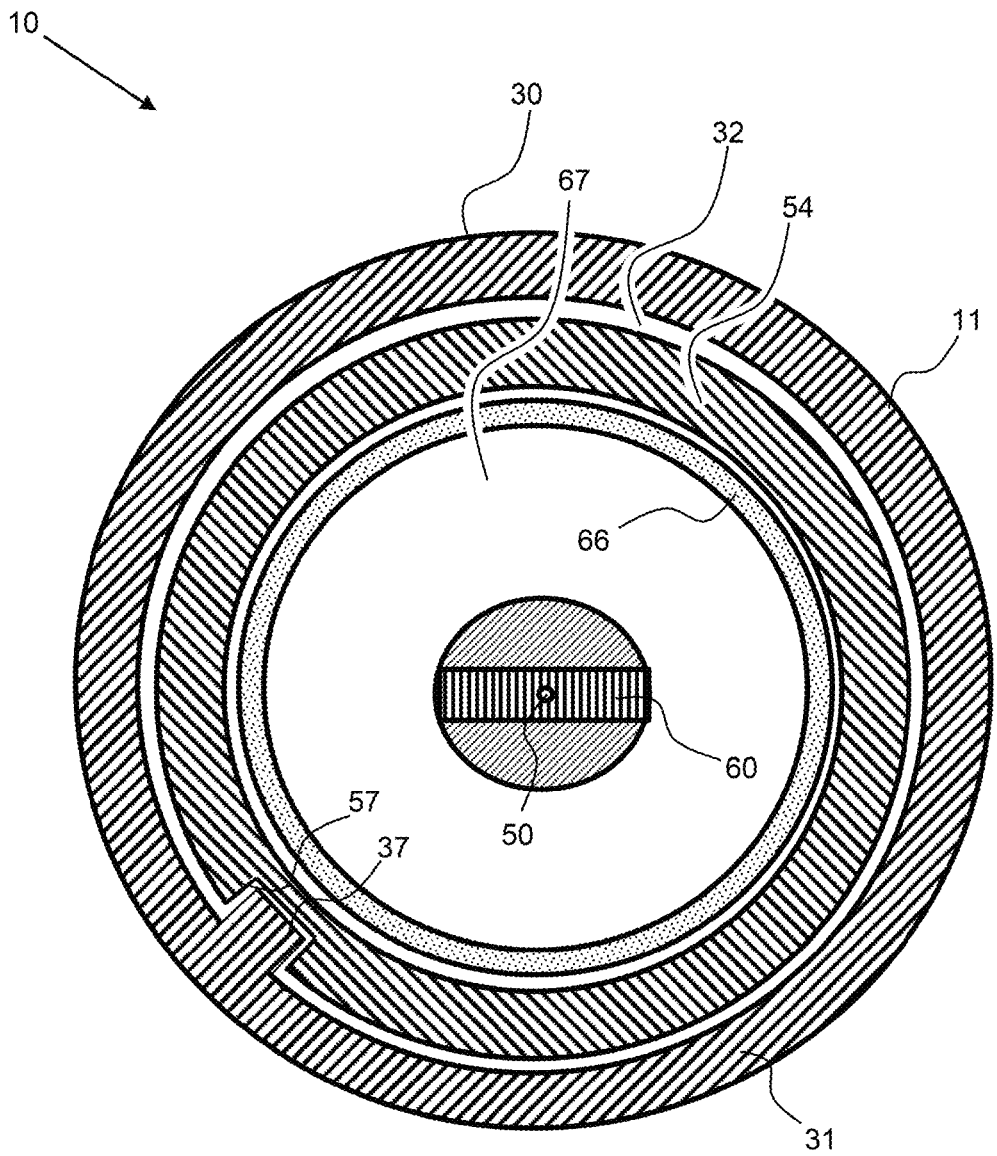
FIG. 7 shows a cross-sectional view of the integral nail polish stirring cap along line 7-7 of FIG. 5.

As shown in FIG. 7 the helical drive shaft 60 extends from the cap button 54 and is centrally located along the drive axis 50. The cap button is configured within the cap body 31 and may have a button guide 57 that engages with a cap button guide 37 to prevent rotation of the cap button as it is depressed. A button guide is shown as a recess and the cap button guide is shown as a protrusion, but this may be reversed. A portion of the spring 66 is shown in the cross-sectional view.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention covers the modifications, combinations and variations of this invention provided they come within the scope of the appended claims and their equivalents.

What is claimed is:

1. An integral nail polish stirring system comprising:

a) a nail polish container comprising:
  i) a reservoir;
  ii) a container open end;

b) a nail polish solution configured within the reservoir of the nail polish container and comprising:
  i) a first component;
  ii) a second component;

c) an integral nail polish stirring cap removably configured over the container open end, the integral nail polish stirring cap comprising:
  i) a cap body forming a cap cavity;
  ii) a rotating drive platform configured within the cap cavity, the rotating drive platform comprising a drive platform aperture;
  iii) a cap button;
  iv) a helical drive shaft connected to the cap button and extending through the drive platform aperture, wherein the helical drive shaft extends along a drive axis;
  wherein the cap button is configured to actuate to rotate the rotating drive platform;

d) a stirring shaft connected to the rotating drive platform an offset distance from said drive axis and extending-to an extended end configured within the nail polish within the nail polish container;
  wherein the stirring shaft rotates with the helical drive platform in a circle about said drive axis;
  wherein the stirring shaft comprises an applicator tip comprising an applicator brush on the extended end of the stirring shaft forming an applicator for application of nail polish solution to a person's nail;
  wherein the helical drive shaft is configured to rotate the rotating drive platform when the cap button is actuated toward the rotating drive platform, wherein the helical drive shaft rotates the rotating drive platform and wherein the rotating drive platform moves the stirring shaft in a circular motion about the drive axis to mix the nail polish solution.

2. The system of claim 1, wherein the stirring shaft is configured parallel to the drive axis.

3. The system of claim 1, wherein the helical drive shaft is rectangular in shape, having a ratio of length to a width that is 1.25:1 or more.

4. The system of claim 1, wherein the integral nail polish stirring cap further comprises a spring configured in an actuation chamber of the cap cavity between the cap button and the rotating drive platform and wherein the spring is compressed when the cap button is actuated toward the rotating drive platform and produces a force to force the cap button back away from the drive platform.

5. The system of claim 4, wherein the spring is a coiled spring.

6. The system of claim 5, wherein the coiled spring comprises a coil of wire.

7. The system of claim 5, further comprising a gasket configured to prevent the nail polish solution from escaping the container via the cap.

8. The system of claim 7, wherein the gasket is configured between the cap button and the cap body and wherein the spring is configured to compress the gasket.

9. The system of claim 1, wherein the integral nail polish stirring cap further comprises a slip plate configured between the spring and the rotating drive platform to reduce friction between the spring and the rotating drive platform.

10. The system of claim 1, wherein the container comprises container threads and wherein the integral nail polish stirring cap comprises cap threads for engagement with the container threads to detachable attach the integral nail polish stirring cap to the nail polish container.

11. The system of claim 1, wherein the cap cavity comprises:
  a cap cavity inner surface; and
  a platform retainer configured to retain the rotating drive platform within the cap cavity.

12. The system of claim 1, wherein when the cap button is depressed once, the rotating drive platform rotates 1 revolution or more about the drive axis.

13. The system of claim 1, wherein when the cap button is depressed once, the rotating drive platform rotates three revolutions or more about the drive axis.

14. The system of claim 1, wherein the cap button is configured to actuate within the cap cavity when the cap button is actuated to rotate the rotating drive platform.

15. The system of claim 14, wherein the integral nail polish stirring cap further comprises a spring configured in an actuation chamber of the cap cavity between the cap button and the rotating drive platform and wherein the spring actuates the cap button out from within the cap cavity.

16. The system of claim 14, wherein the helical drive shaft is retained within the cap cavity when the cap button is actuated within the cap cavity.

* * * * *